US012553683B2

(12) United States Patent
EuDaly

(10) Patent No.: US 12,553,683 B2
(45) **Date of Patent: *Feb. 17, 2026**

(54) RUBBER BAND GUN, METHOD OF USE, AND METHOD OF ASSEMBLY

(71) Applicant: Elastic Precision, LLC, Plano, TX (US)

(72) Inventor: Brent EuDaly, Centerville, KS (US)

(73) Assignee: Elastic Precision, LLC, Plano, TX (US)

( * ) Notice: Subject to any disclaimer, the term of this patent is extended or adjusted under 35 U.S.C. 154(b) by 61 days.

This patent is subject to a terminal disclaimer.

(21) Appl. No.: 18/536,587

(22) Filed: Dec. 12, 2023

(65) Prior Publication Data

US 2024/0102768 A1 Mar. 28, 2024

Related U.S. Application Data

(63) Continuation of application No. 17/557,395, filed on Dec. 21, 2021, now Pat. No. 11,841,207, which is a continuation-in-part of application No. 16/952,437, filed on Nov. 19, 2020, now abandoned.

(60) Provisional application No. 62/939,209, filed on Nov. 22, 2019.

(51) Int. Cl.
*F41B 7/08* (2006.01)
*F41B 7/02* (2006.01)

(52) U.S. Cl.
CPC ..... *F41B 7/025* (2013.01)

(58) Field of Classification Search
CPC .. F41B 5/025; F41B 5/08; F41B 7/025; F41B 7/08
USPC ..... 124/17, 18
See application file for complete search history.

(56) References Cited

U.S. PATENT DOCUMENTS

| | | | |
|---|---|---|---|
| 1,234,163 | A | 7/1917 | Henderson |
| 1,660,767 | A | 2/1928 | Ronning et al. |
| 1,723,554 | A | 8/1929 | Malott |
| 1,724,708 | A | 8/1929 | Harris |
| 1,759,084 | A | 5/1930 | Baum et al. |
| 1,821,381 | A | 9/1931 | Gerken |
| 1,883,826 | A | 10/1932 | Schmidt |
| 1,909,927 | A | 5/1933 | Beauchamp et al. |

(Continued)

FOREIGN PATENT DOCUMENTS

CN 213688061 7/2021

OTHER PUBLICATIONS

"International Search Report and Written Opinion; PCT/US 2022/053506".

*Primary Examiner* — John E Simms, Jr.
(74) *Attorney, Agent, or Firm* — AVEK IP, LLC

(57) ABSTRACT

A toy gun having a pair of sides are joined together using a number of pins inserted through pin holes passing through the pair of sides. A trigger and a slide are sandwiched between the pair of sides and are secured therein. A pivot pin allows the trigger to be pulled rearwardly such that it presses against the slide, moving it reward as well. When this occurs, the slide moves out from between the two sides, pushing the elastic bands away from static notches located on the rear end of the sides. This causes the top-most elastic band to fire away from the gun, and the remaining elastic bands to be reseated upwardly into the next adjacent respective static notch. The elastic bands pull the trigger back into its original position, allowing for semi-automatic firing.

5 Claims, 18 Drawing Sheets

(56) References Cited

U.S. PATENT DOCUMENTS

| | | | | | |
|---|---|---|---|---|---|
| 1,921,017 | A | | 8/1933 | Weber | |
| 2,008,595 | A | | 7/1935 | Reed | |
| 2,289,490 | A | * | 7/1942 | Fisher | F41B 7/025 124/19 |
| 2,462,723 | A | | 2/1949 | Crnich | |
| 2,529,047 | A | | 11/1950 | Paul | |
| 2,550,873 | A | | 5/1951 | Siders | |
| 2,689,558 | A | * | 9/1954 | Sealer | F41B 7/025 124/19 |
| 2,697,425 | A | | 12/1954 | McElveen | |
| 2,741,238 | A | | 4/1956 | Arnold | |
| 2,793,635 | A | | 5/1957 | Koeller | |
| 2,917,037 | A | | 12/1959 | Henderson | |
| 3,137,958 | A | | 6/1964 | Lewis | |
| 3,437,084 | A | | 4/1969 | Hyter | |
| 3,468,296 | A | | 9/1969 | Duval | |
| 3,494,345 | A | * | 2/1970 | Edward | F41B 7/025 124/19 |
| 3,812,833 | A | | 5/1974 | Skillern | |
| 3,919,996 | A | | 11/1975 | McAlister | |
| 4,033,313 | A | | 7/1977 | Ryan | |
| 4,165,729 | A | | 8/1979 | Niemirow | |
| 4,308,850 | A | | 1/1982 | Hunter | |
| 4,379,445 | A | | 4/1983 | Lobiondo | |
| 4,676,219 | A | | 6/1987 | Miller | |
| 4,800,864 | A | | 1/1989 | Small | |
| 4,949,494 | A | * | 8/1990 | Mims | F41B 7/025 124/19 |
| 5,170,770 | A | | 12/1992 | Vosloh | |
| 5,205,266 | A | | 4/1993 | Kilby, Jr. | |
| 5,222,472 | A | | 6/1993 | Landingham | |
| 5,460,150 | A | * | 10/1995 | Joppe | F41B 7/025 124/19 |
| 5,595,165 | A | | 1/1997 | Conte | |
| 5,692,489 | A | | 12/1997 | Swanson et al. | |
| 7,690,371 | B2 | | 4/2010 | Slaven | |
| 9,140,517 | B2 | | 9/2015 | Coulston | |
| 11,841,207 | B2 | * | 12/2023 | Eudaly | F41B 7/025 |
| 2008/0029104 | A1 | | 2/2008 | Vanderpool | |
| 2009/0314272 | A1 | * | 12/2009 | Lin | F41B 3/02 124/48 |
| 2013/0340734 | A1 | * | 12/2013 | Coulston | F41B 7/003 124/19 |
| 2016/0363411 | A1 | * | 12/2016 | EuDaly | A63H 5/04 |
| 2016/0363412 | A1 | * | 12/2016 | EuDaly | F41B 7/003 |
| 2021/0156640 | A1 | * | 5/2021 | EuDaly | F41B 7/003 |
| 2022/0113111 | A1 | | 4/2022 | Eudaly | |

* cited by examiner

RUBBER BAND GUN, METHOD OF USE, AND METHOD OF ASSEMBLY

CROSS-REFERENCE TO RELATED APPLICATION

This application is a continuation of U.S. patent application Ser. No. 17/557,395 filed Dec. 21, 2021, which is a continuation-in-part of and claims priority in U.S. patent application Ser. No. 16/952,437 filed Nov. 19, 2020, which claims priority in U.S. Provisional Patent Application No. 62/939,209 filed Nov. 22, 2019, which is incorporated herein by reference.

BACKGROUND OF THE INVENTION

1. Field of the Invention

The present invention relates generally to a rubber band gun and method for use and assembly thereof, and more specifically to rubber band launching toy gun that fires six rubber bands in rapid succession, releasing only one rubber band with each trigger pull.

2. Description of the Related Art

Elastic rubber band launching toy guns exist in many forms, ranging from very simple single shot models to extremely complex models capable of launching hundreds of elastic bands in a matter of seconds.

Traditional rubber band guns use a variety of mechanisms to hold a band in a stretched position and for releasing that band, resulting in the band being "fired" from the gun toward a target. The simplest such release mechanism uses a simple clothespin which can clasp down on the band and causes the band to be released upon depressing the pin. This results in a simple, yet limited single-fire pistol.

The most common style of elastic band launching gun uses a plastic, multi-toothed rotating wheel to release rubber bands in a controlled manor one at a time. Another type of elastic band launching gun uses a "step-up" action to move a collection of individual elastic bands up a series of notches, releasing one elastic band off of the topmost notch with each advancement of the action More complicated rubber band guns include repeater pistols which rely upon a tooth wheel which spins as the trigger is depressed. These pistols allow for a rapid succession of shots, but each shot will only fire the band or bands as they are loaded onto the wheel. There is no way to load up additional bands for firing using the wheel mechanism alone.

Heretofore there has not been available a system or method for a rubber band gun with the advantages and features of the present invention.

BRIEF SUMMARY OF THE INVENTION

The present invention relates generally to an elastic rubber band launching toy gun that uses a new method to launches multiple elastic bands in rapid succession using a simple assembly of only a few individual parts, and featuring a moving slide in order to mimic the action on a real hand gun. A pair of sides are joined together using a number of pins inserted through pin holes passing through the pair of sides. A trigger and a slide are sandwiched between the pair of sides and are secured therein. A pivot pin allows the trigger to be pulled rearwardly such that it presses against the slide, moving it reward as well. When this occurs, the slide moves out from between the two sides, pushing the elastic bands away from static notches located on the rear end of the sides. This causes the top-most elastic band to fire away from the gun, and the remaining elastic bands to be reseated upwardly into the next adjacent respective static notch. The elastic bands pull the trigger back into its original position, allowing for semi-automatic firing.

In one embodiment, the outside slides move rather than the central core slide, thereby providing a more realistic action of a hand gun. In this version, the trigger mechanism includes a pair of slots and slotted pins which can slide within those slots. This allows for smoother firing of the elastic bands from the gun.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
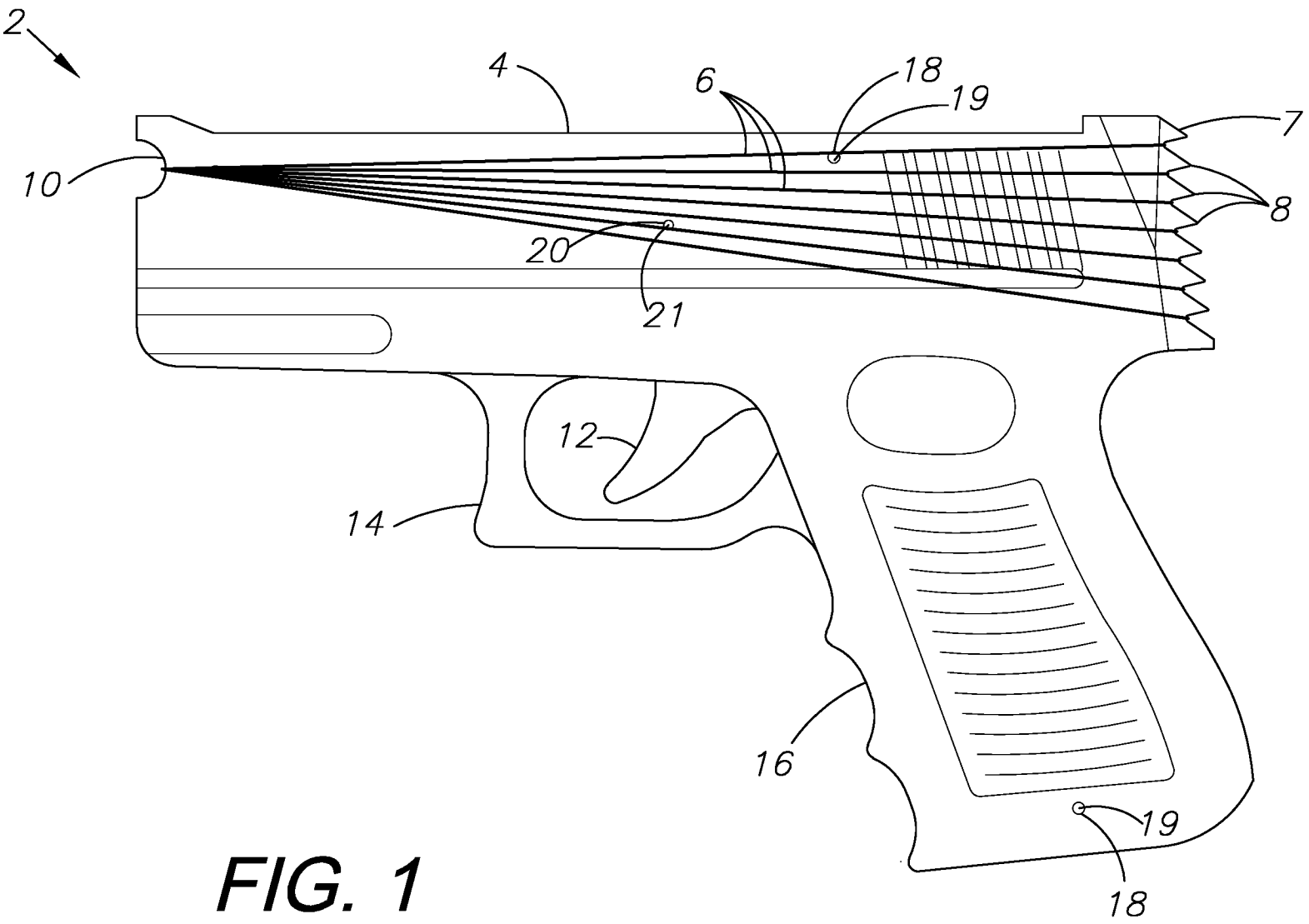
FIG. 1 is a left-side elevational view of a preferred embodiment of the present invention.
Figure 2:
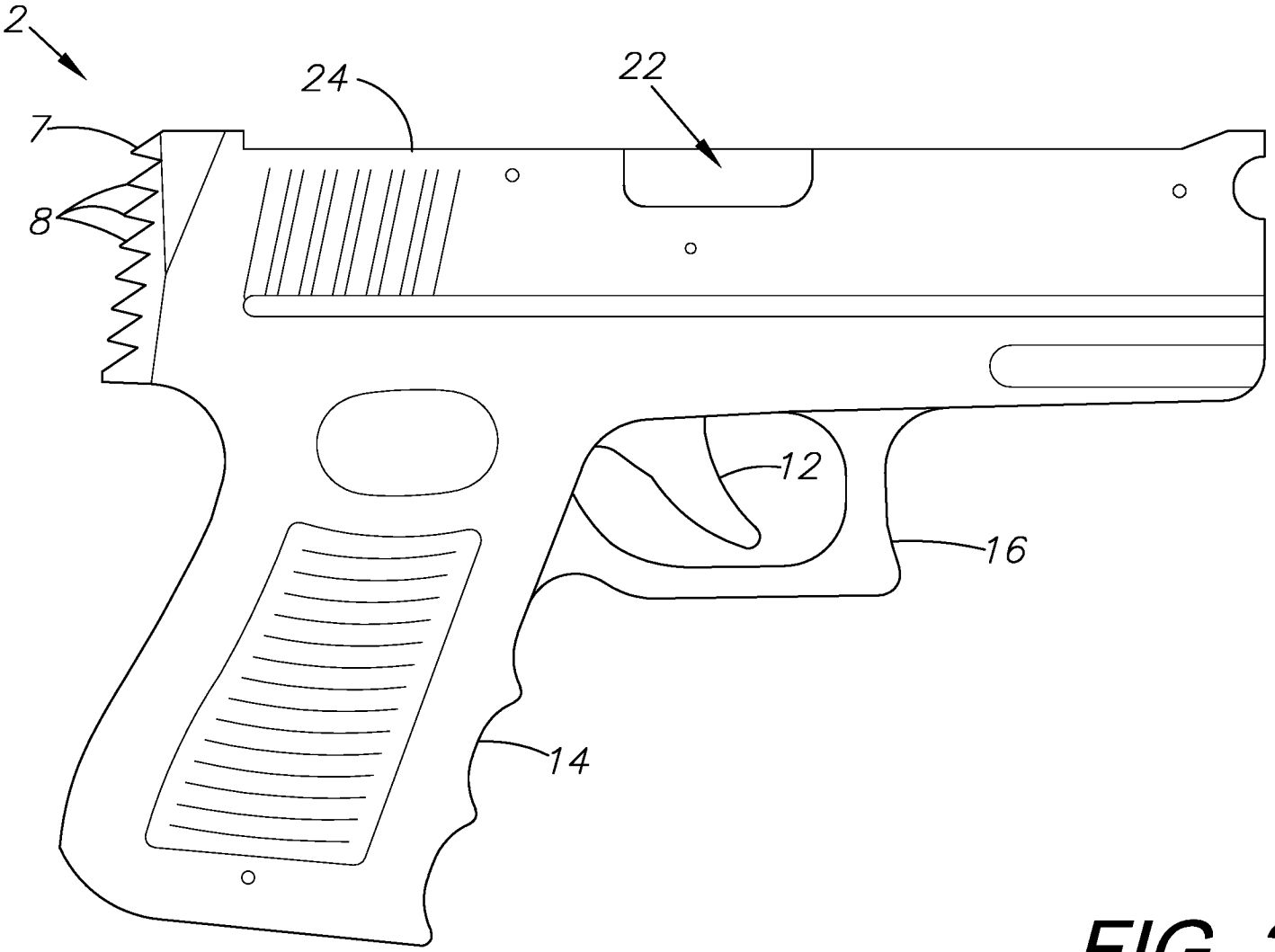
FIG. 2 is a right-side elevational view thereof.
Figure 3:
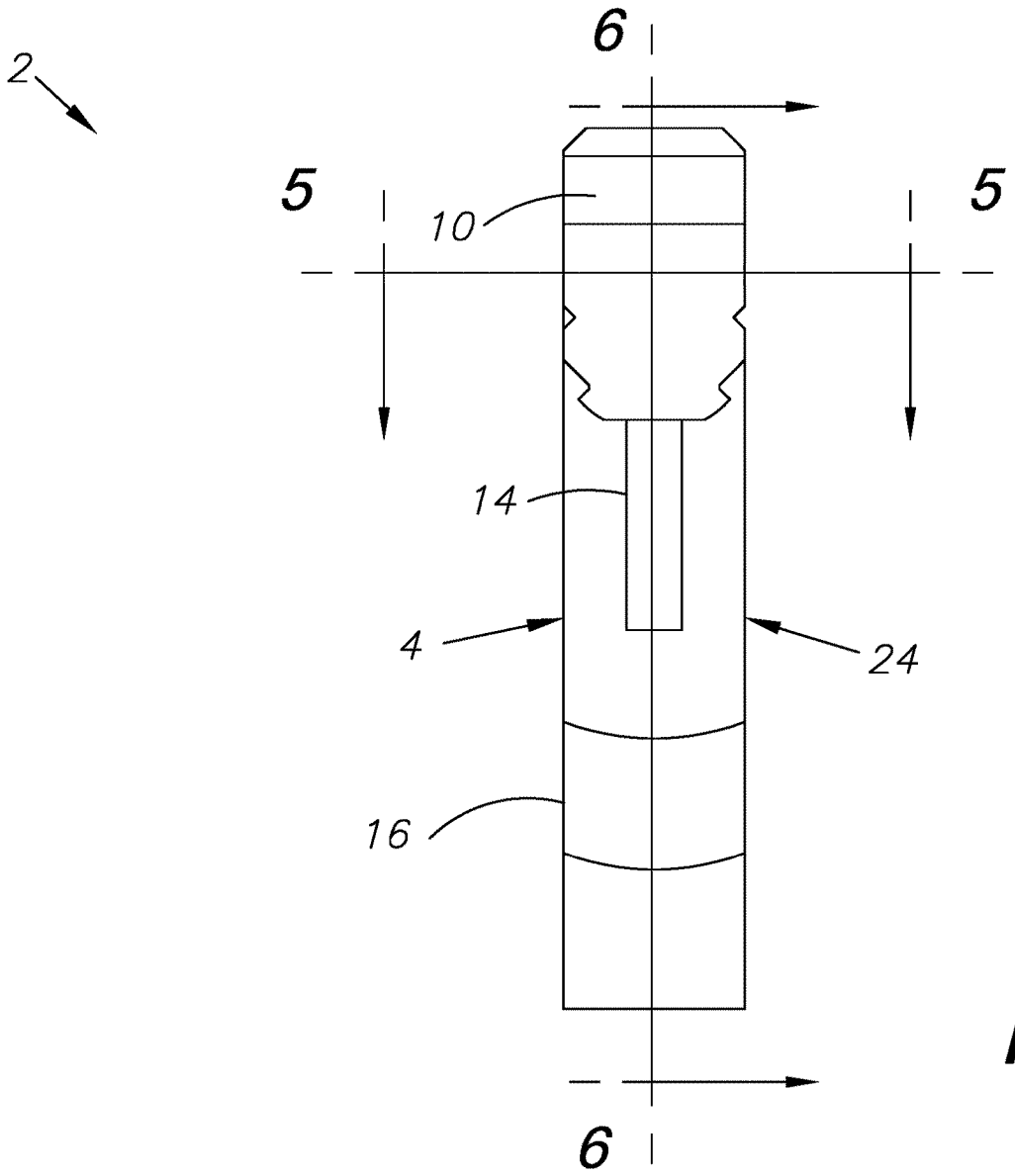
FIG. 3 is a front elevational view thereof.
Figure 4:
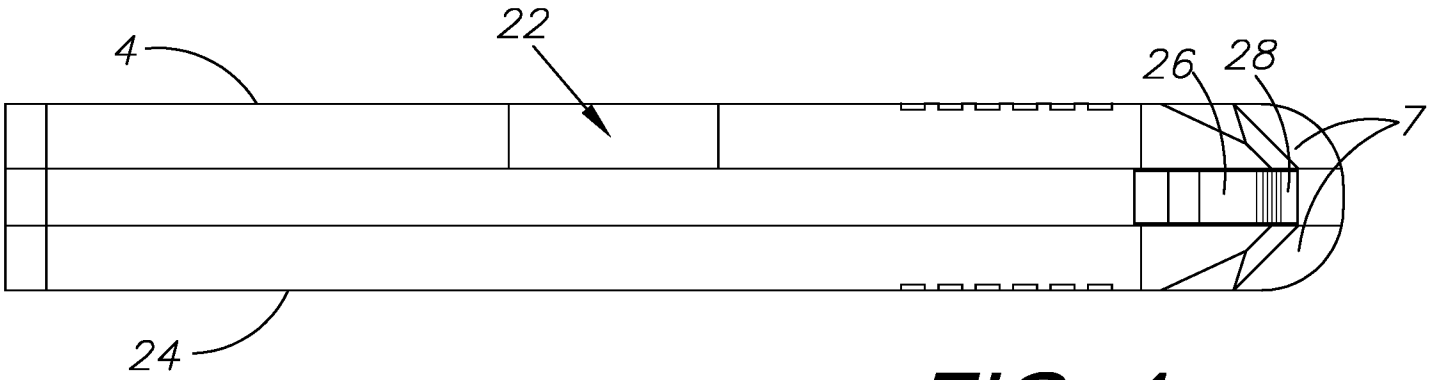
FIG. 4 is a top plan view thereof.
Figure 5:
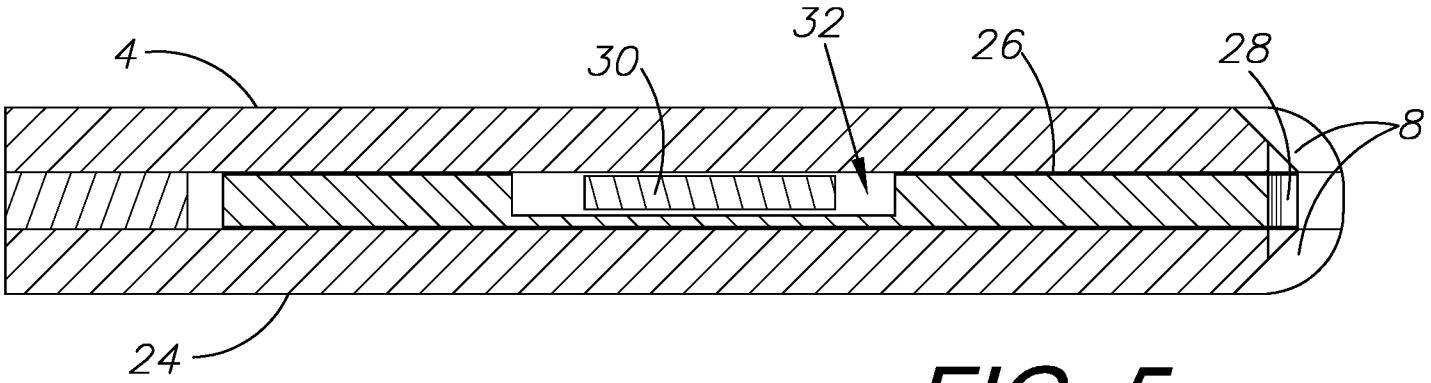
FIG. 5 is a top sectional view taken about the line of FIG. 3.
Figure 6:
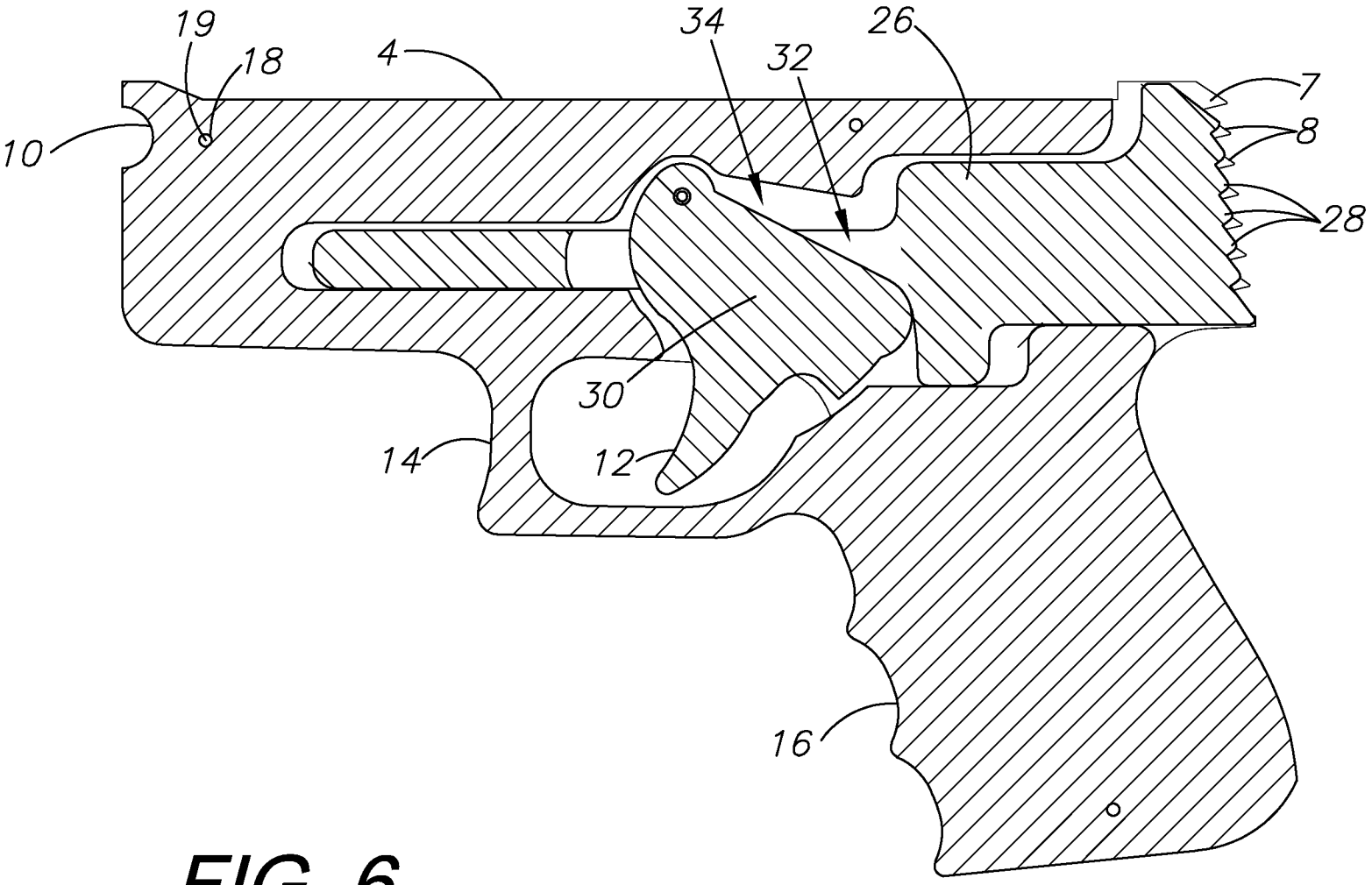
FIG. 6 is a side sectional view taken about the line of FIG. 3.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. First Embodiment Rubber Band Gun 2

As shown in FIGS. 1-9, an embodiment of the present invention rubber band gun 2 is formed in the shape of a 9 mm handgun. This embodiment is constructed from four main parts: a first side 4, a second side 24, a trigger 30 which includes a trigger-pull 12, and a slide 26. A main gun frame includes the first half 4 and the second half 24 which each include a handle 16, a front notch 10, a trigger guard 14, a plurality of rear notches 8 at the rear of the main gun frame including a top notch 7. A slide cavity 34 for holding a slide 26 in place is provided within the first side 4. The slide 26 has a trigger cavity 32 for receiving an upper trigger portion 30 which pivots about a pin 21 in a pin slot 20 to move the slide 26 backwards when a trigger pull 12 is pulled backwards.

Figure 7:
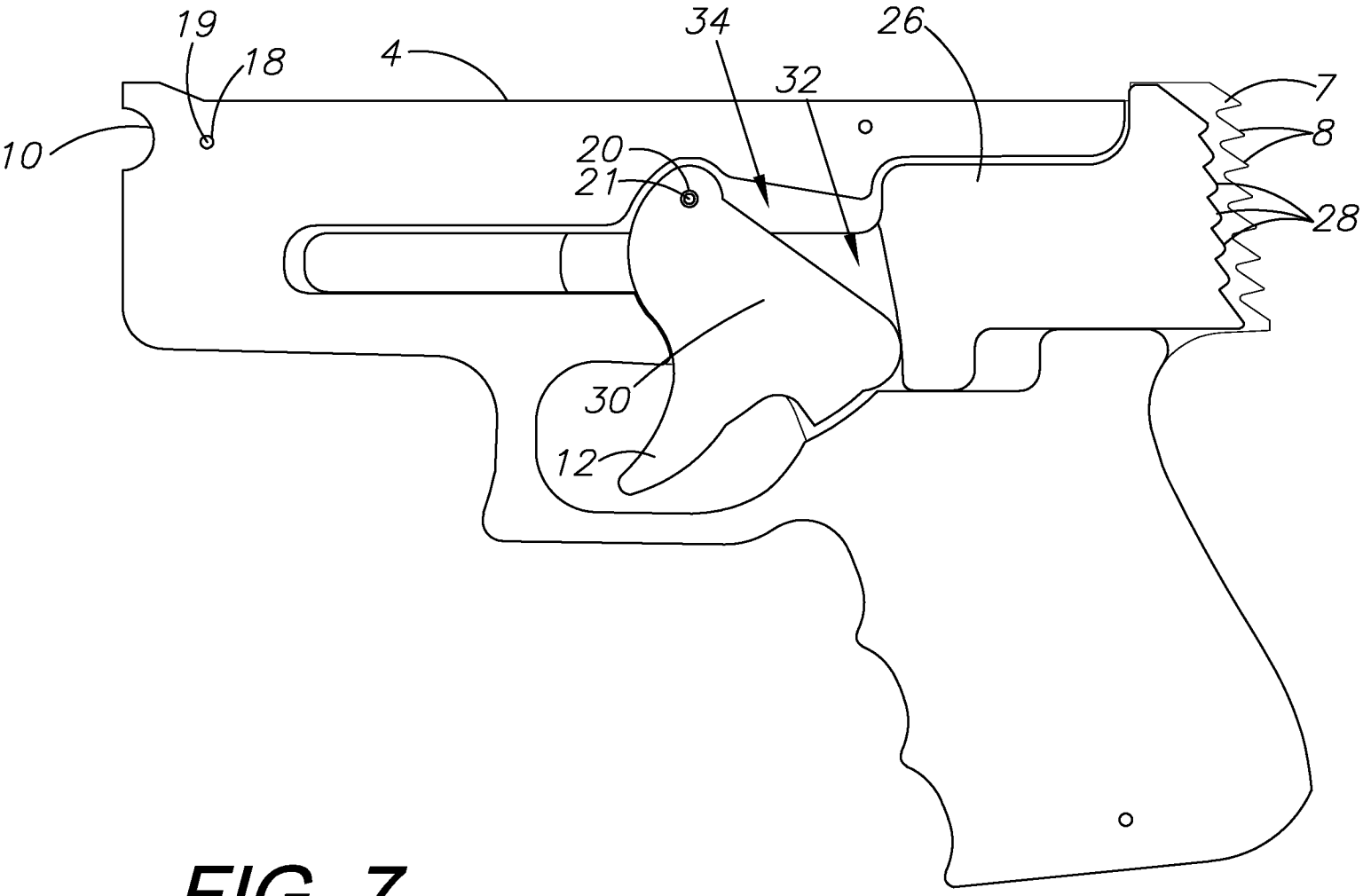
FIG. 7 is a side elevational view of one half of the embodiment of FIG. 1 with a trigger element in a first position.
Figure 8:
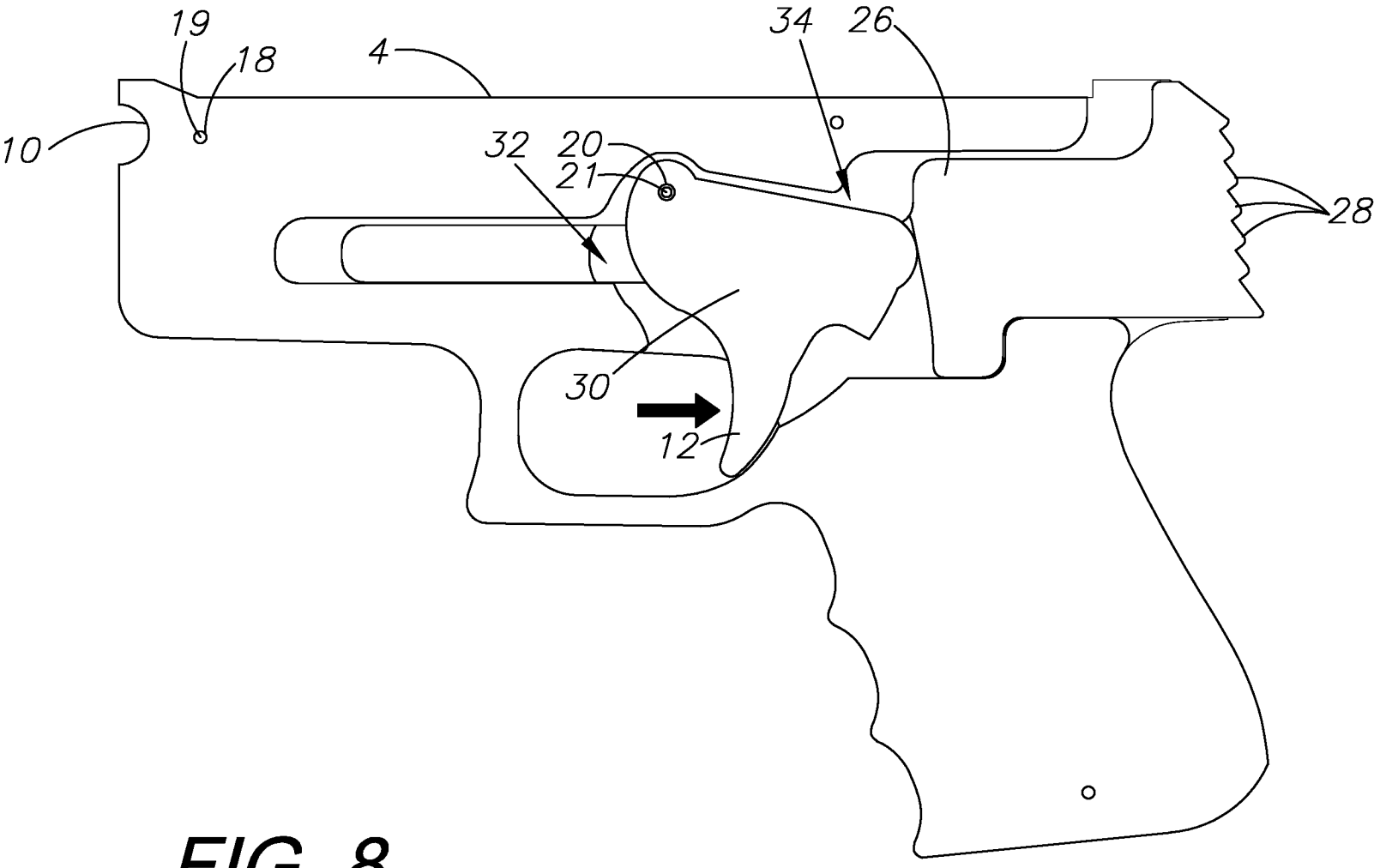
FIG. 8 is a side elevational view thereof showing the trigger element in a second position.
Figure 9:
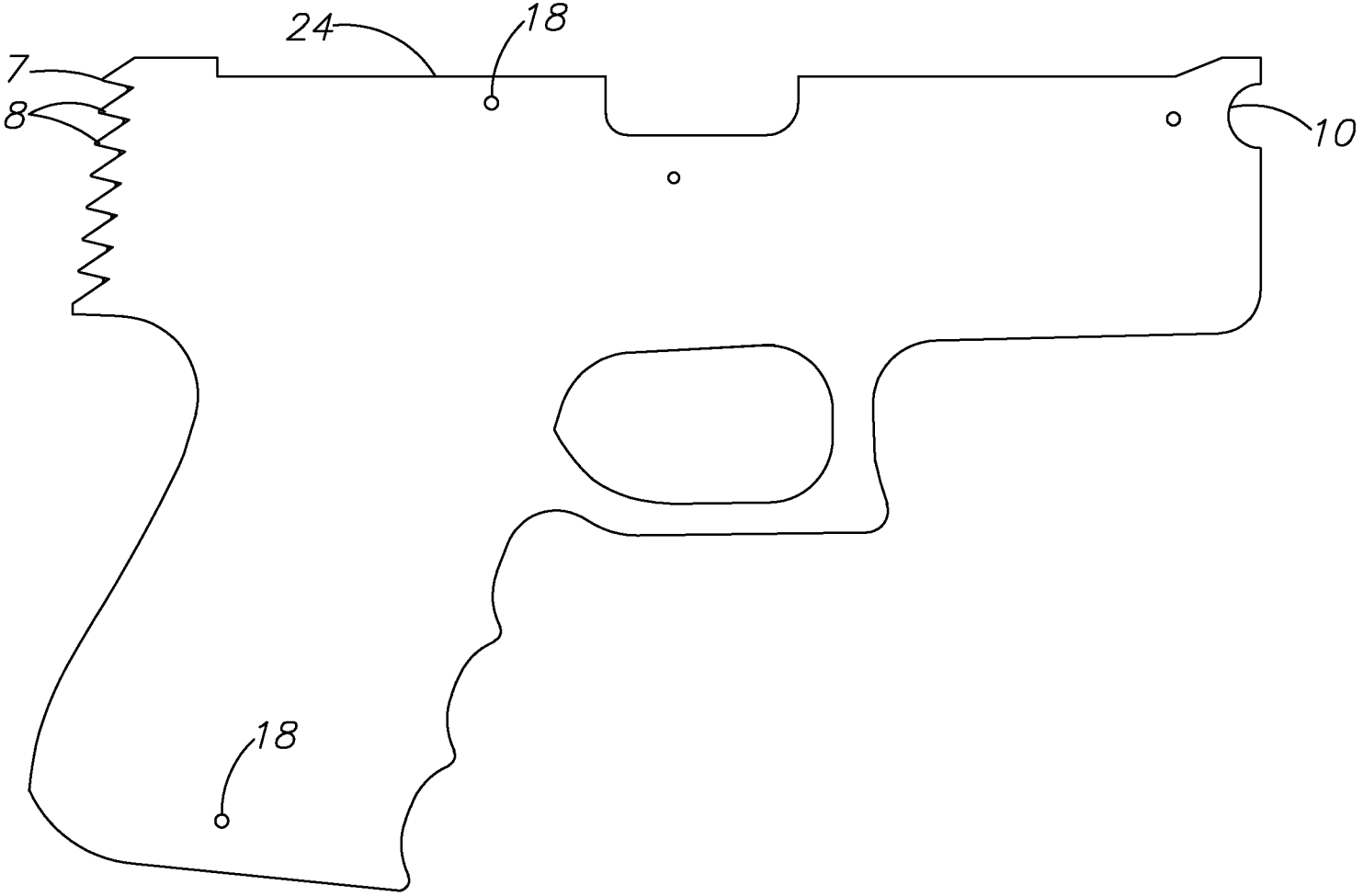
FIG. 9 is a side elevational view of a second half of the embodiment of FIG. 1.
Figure 10:
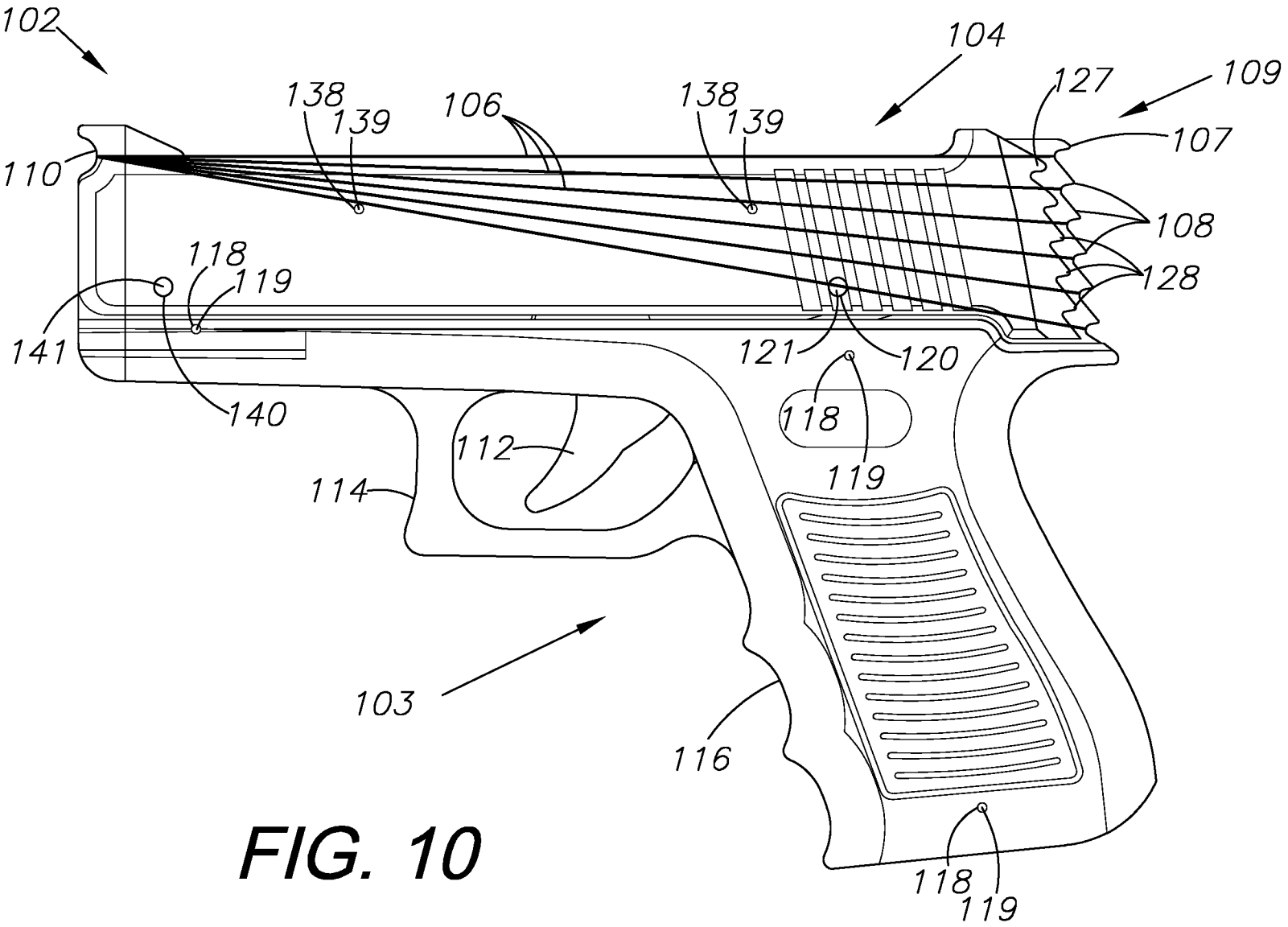
FIG. 10 is a left-side elevational view of a preferred embodiment of the present invention.

As shown in FIGS. 7 and 8, the trigger-pull 12 moves backwards when pulled, rocking the trigger 30 upwards such that it pushes the slide 26 backwards. This causes a plurality of secondary rear notches 28, located at the rear of the slide 26, to push a plurality of rubber bands 6 backwards, off of the first plurality of rear notches 8, and causing the top most rubber band, originally engaged with the top notch 7, to be fired from the gun away from the front notch 10. The remaining rubber bands 6 then cause the slide 26 to be pulled back toward the front of the gun, moving the trigger pull back into its first position as shown in FIG. 7, after which the remaining rubber bands are incrementally moved upwards to the next adjacent one of the plurality of notches 8, with one being advanced to the top notch 7. This provides semi-automatic firing of the rubber bands 6 from the gun without the need for any additional rubber bands other than those to be fired from the gun.

A number of pins 19 an be used to hold the slide element 26 and trigger 30 between the first 4 and second 24 sides by passing through respective pin receivers 18 located throughout the structure of the gun. All parts could be made from any suitable material, but wood is intended to be the preferred material.

This embodiment is shaped to resemble a 9 mm handgun. The firing and resetting process from a first, loaded position to a second, fired position back to the first, loaded position is done without the need for a separate band, spring, or other trigger element specifically for pulling the trigger back to a starting, non-firing position. An ejector 22 recess is included in the second side 24 of the gun.

III. Second Embodiment Rubber Band Gun 102

Figure 11:
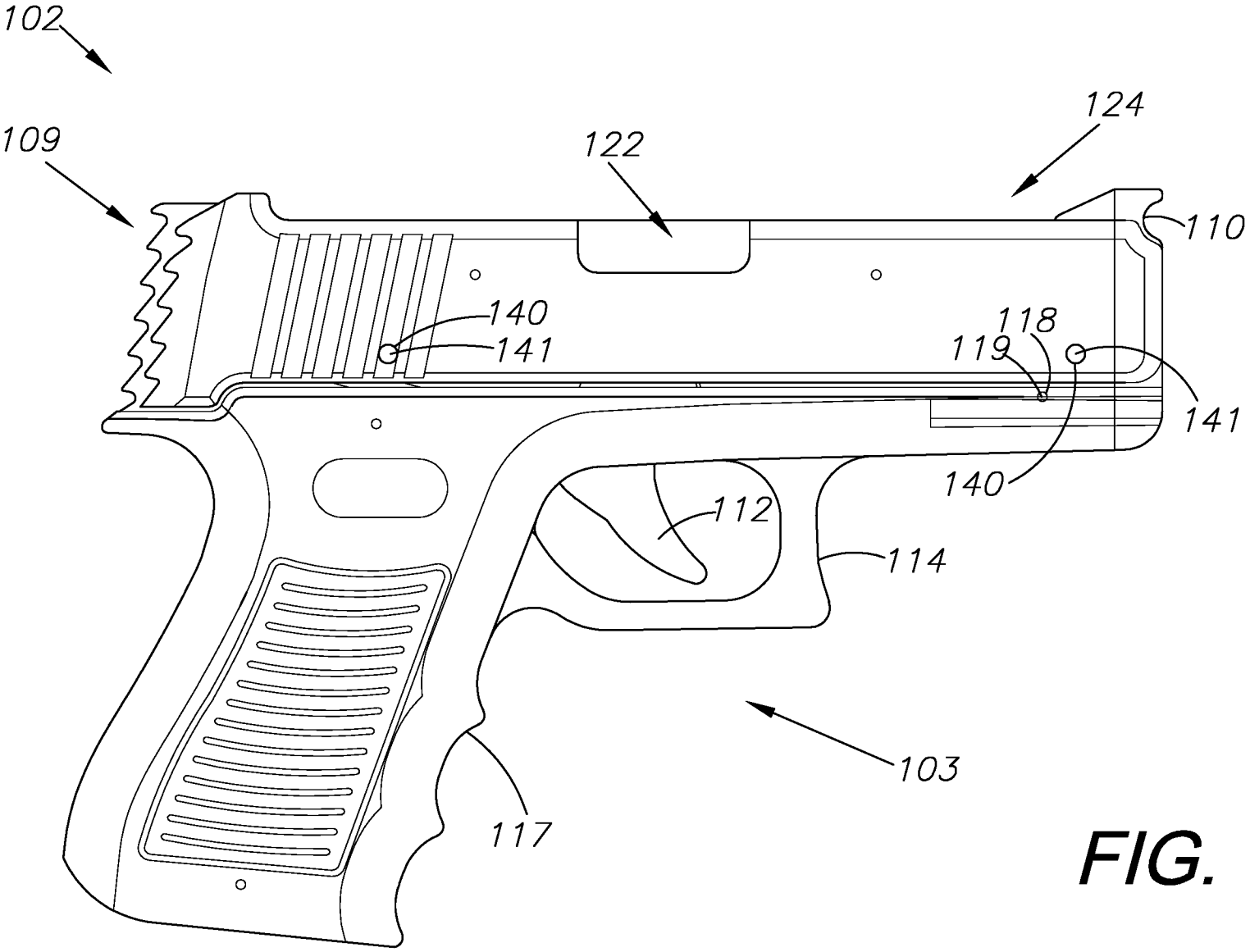
FIG. 11 is a right-side elevational view thereof.
Figure 12:
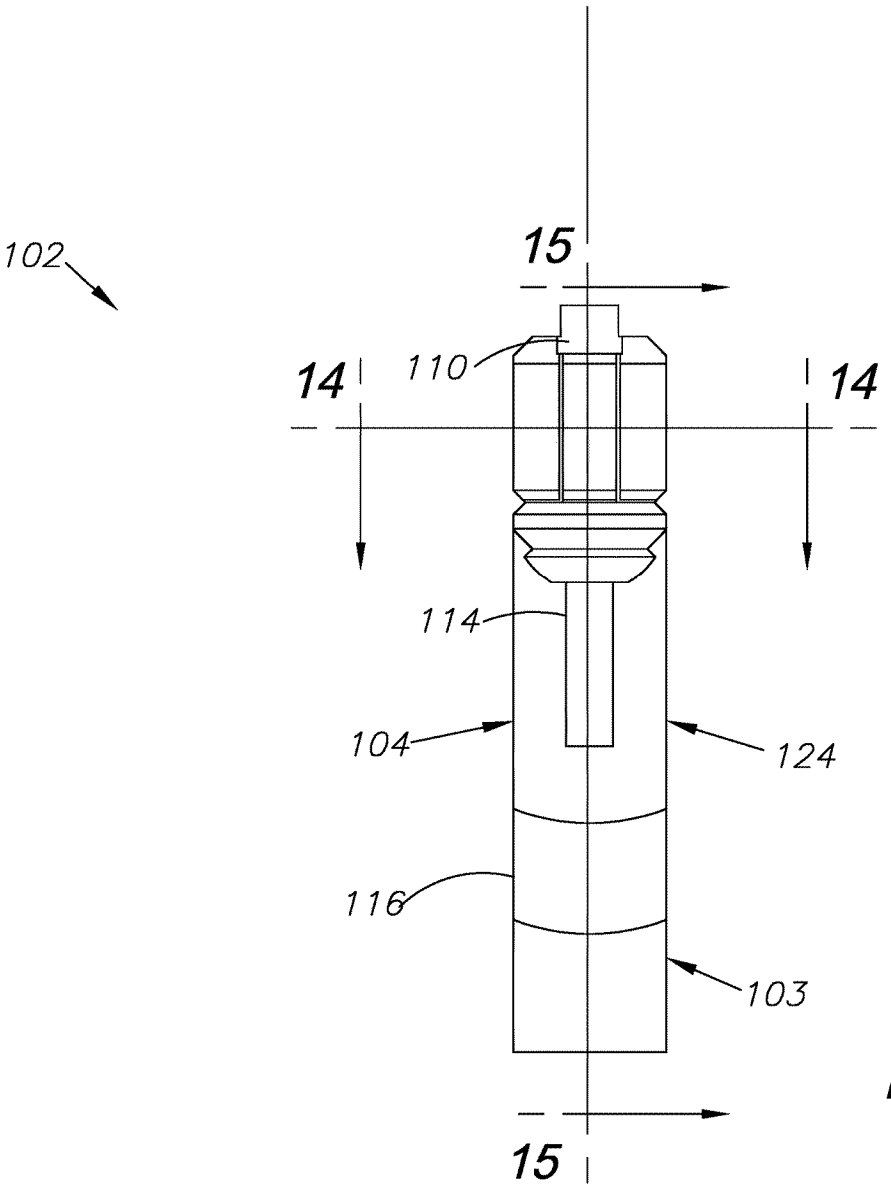
FIG. 12 is a front elevational view thereof.
Figure 13:
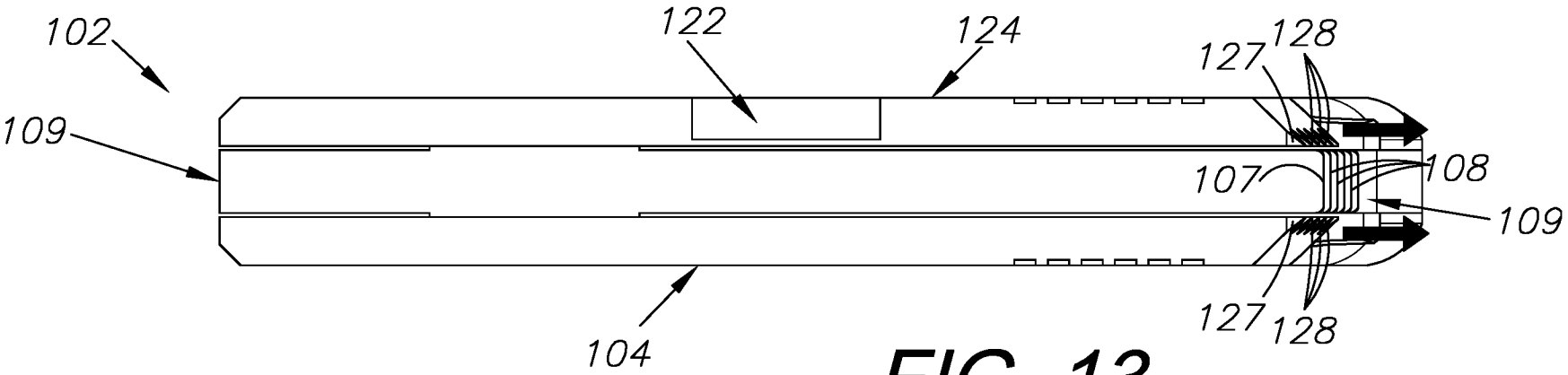
FIG. 13 is a top plan view thereof.
Figure 13A:
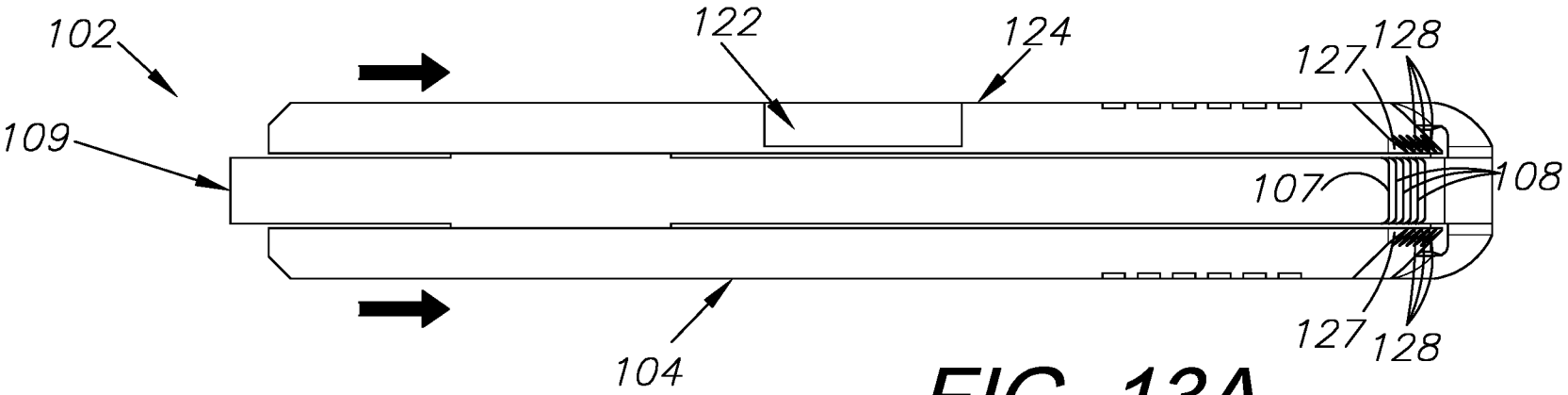
FIG. 13A is a top plan view thereof shown in a second, firing orientation.
Figure 14:
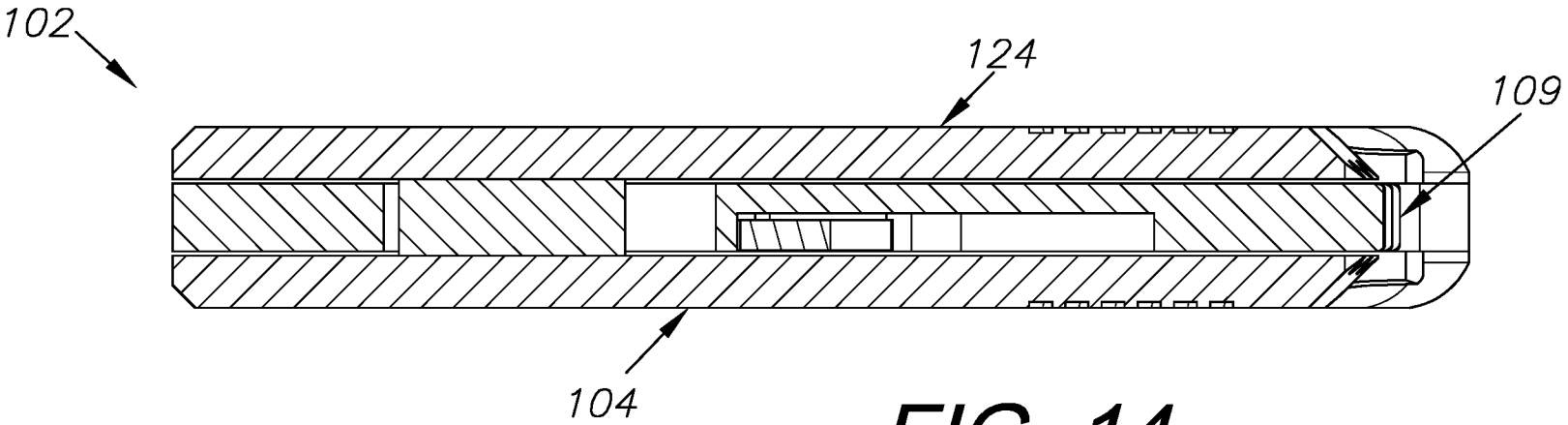
FIG. 14 is a top sectional view taken about the line of FIG. 12.

As shown in FIGS. 10-18, another embodiment of the present invention rubber band gun 102 is formed in the shape of a 9 mm handgun. This embodiment is constructed from five main parts: a left side slide 104, a left side handle 116, a right side slide 124, a right side handle 117, and a center handle 103 which includes a trigger guard 114 and a trigger mechanism 112 controlling the central slide 109 element. When these elements are formed into the gun shape as shown in FIG. 11, a number of different pins join the various elements together. Body pins 119 are inserted through the body pin receivers 118 which pass through the left side handle, the center handle, and the right side handle to join those elements into a static gun frame base. Slide pins 139 are similarly inserted through slide pin receivers 138. These slide pins 139 only pass through the right slide 124 and the left slide 104 and hold them rigidly in lock with one another. The slide pins 139 and body pins 119 may be made of wood or other suitable material. An exterior recess 122 may be included on the right handle half to resemble a shell ejection recess of a firearm.

The central slide 109 element terminates in several rear notches 108 including a top firing notch 107. The rubber band 106 stored at the top firing notch 107 will be the next to be deployed when the gun 102 is fired. The right and left slides 104, 124 each have a matching number of rear slide notches 128 and each have a corresponding top slide firing notch 127. When the slides 104, 124 are adjusted rearward, the top slide firing notch 127 disengages the rubber band 106 stored within the top firing notch 107 and causes it to be ejected forward away from the front notch 110. The remaining rubber bands 106 are then adjusted upwardly by the rear slide notches 128 to the next rear notch 108 up from their previous positions, with one rubber band being repositioned to the top fire notch 107.

Figure 15:
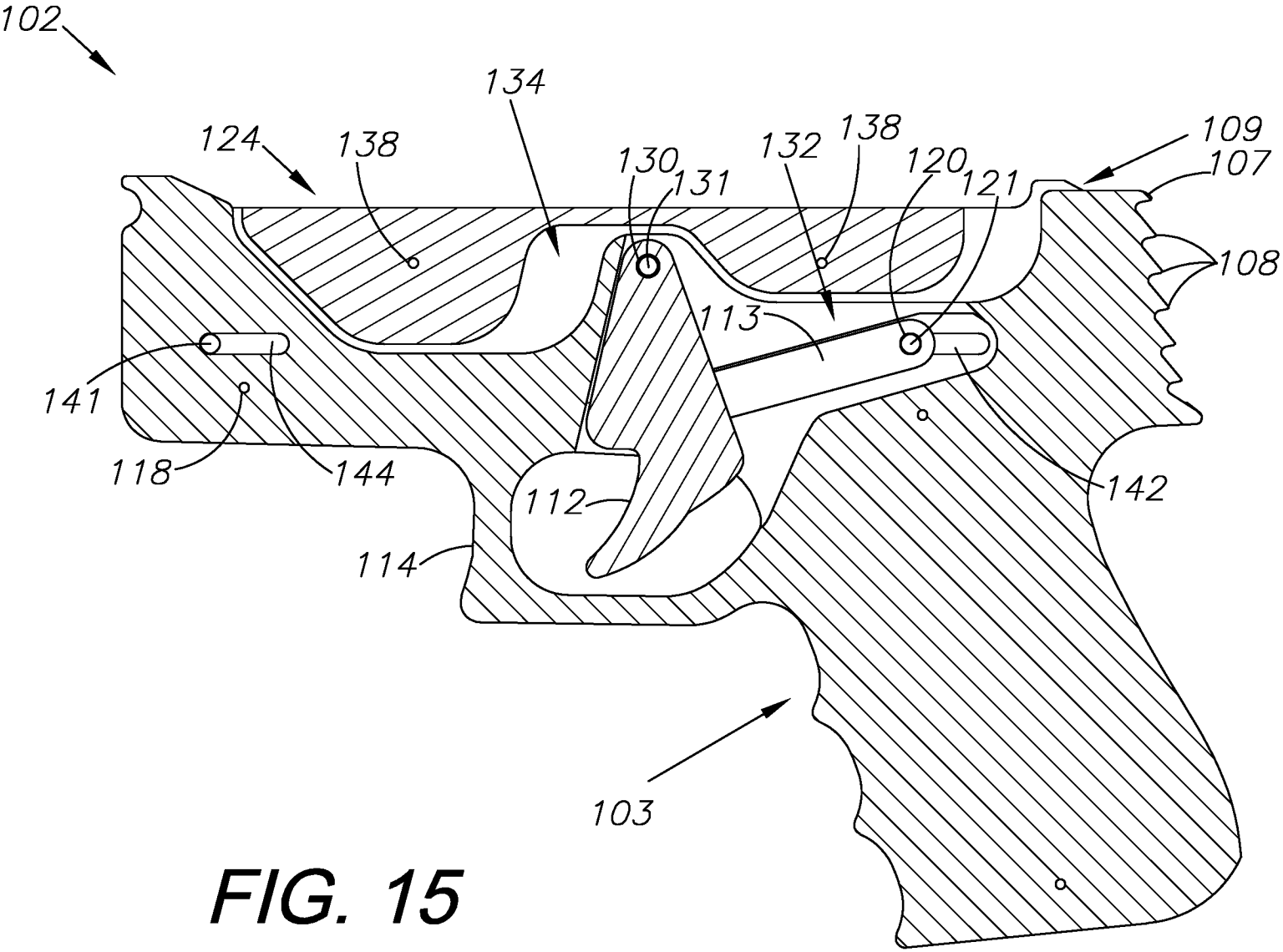
FIG. 15 is a side sectional view taken about the line of FIG. 12.
Figure 15A:
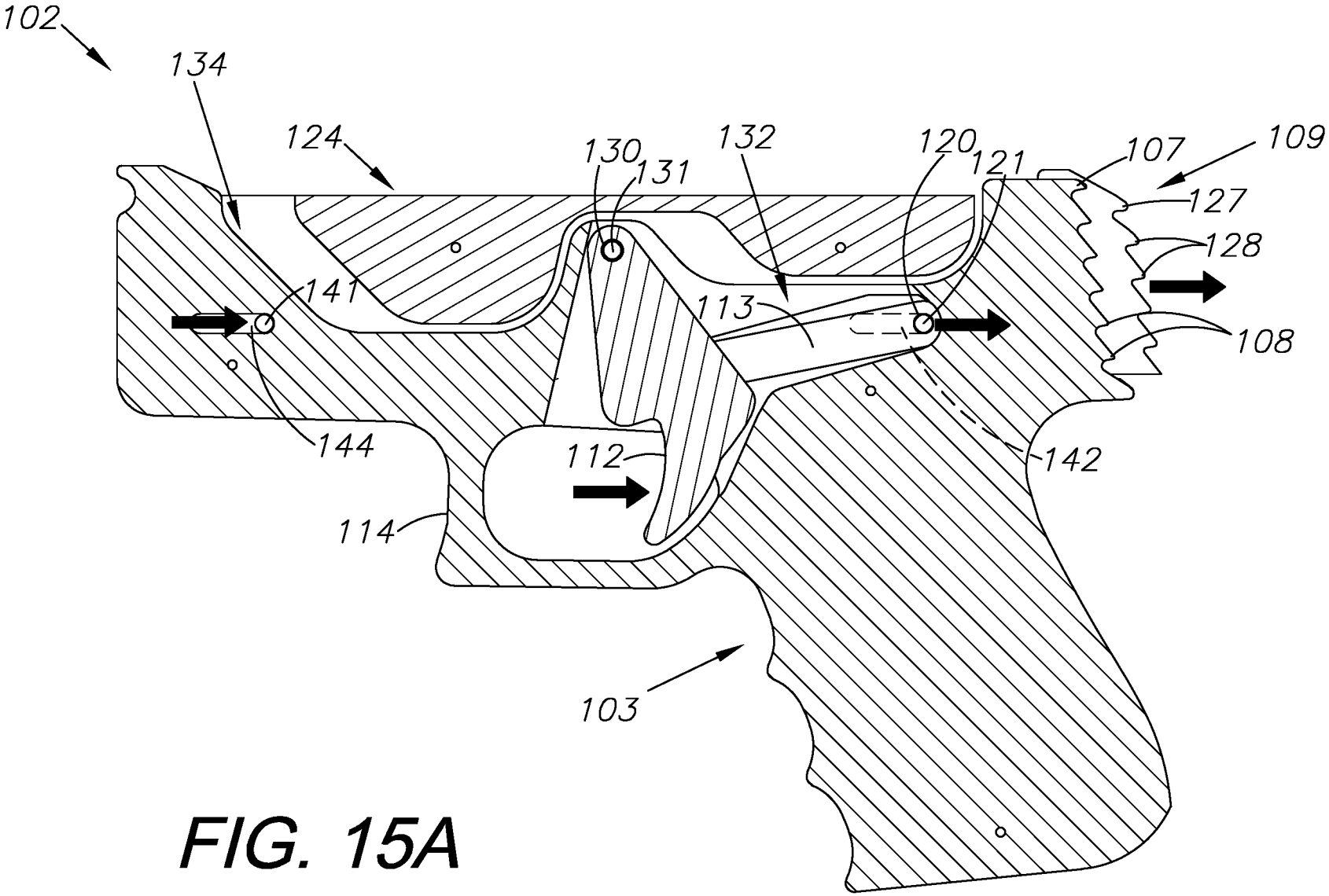
FIG. 15A is another side sectional view about the same line as FIG. 15 shown in a second, firing orientation.

A front pin 141 and rear pin 140 pass through front 140 and rear 120 pin receivers respectively. These pins similarly join the right 124 and left 104 slides together, but also function to allow the slides 104, 124 to move rearwardly when the trigger 112 is pressed. FIGS. 15 and 15A show how the front 141 and rear 121 pins move laterally rearward when the trigger 112 is pressed, thereby sliding the right 124 and left 104 slides rearwardly with it. A front slot 144 and rear slot 142 within the center handle 103 allow the respective front 141 and rear 140 pins to slide forward and backwards to accommodate for the movement in the trigger 112 and the slides 104, 124.

The trigger 112 is pinned to a trigger post 113 which is connected to the rear pin 121. When the trigger 112 is depressed, the trigger post 113 moves the rear pin rearward, and then the force of the remaining rubber bands 106 pushes the slides back forward, moving the trigger post 113 via the rear pin and resetting the trigger 112.

A slide relief 134 within the right 104 and left 124 slides secure the slides with the center handle portion 103 and prevent the slides from moving too far forwards or rearwards. A trigger relief 132 within the center handle ensures the trigger 112 and trigger post 113 have room to move within the center handle 103. FIG. 15 shows the slide in a forward position, and FIG. 15A shows the trigger being depressed rearwardly, thereby moving the entire slide reward which would dislodge the upper-most elastic band 106 from the top fire notch 107.

Figure 16:
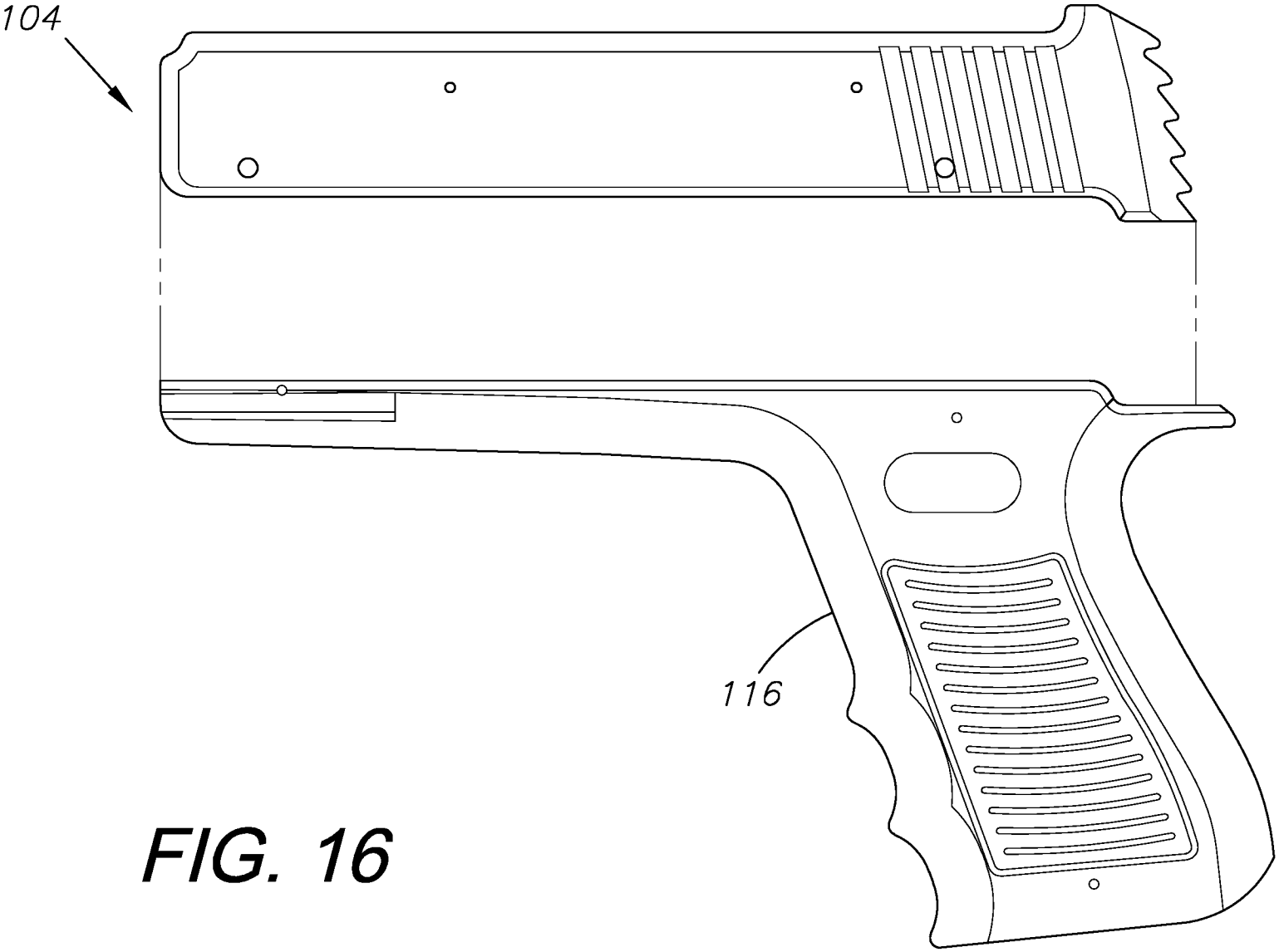
FIG. 16 is a partially-exploded left side elevational view of a left slide element and left handle element.
Figure 17:
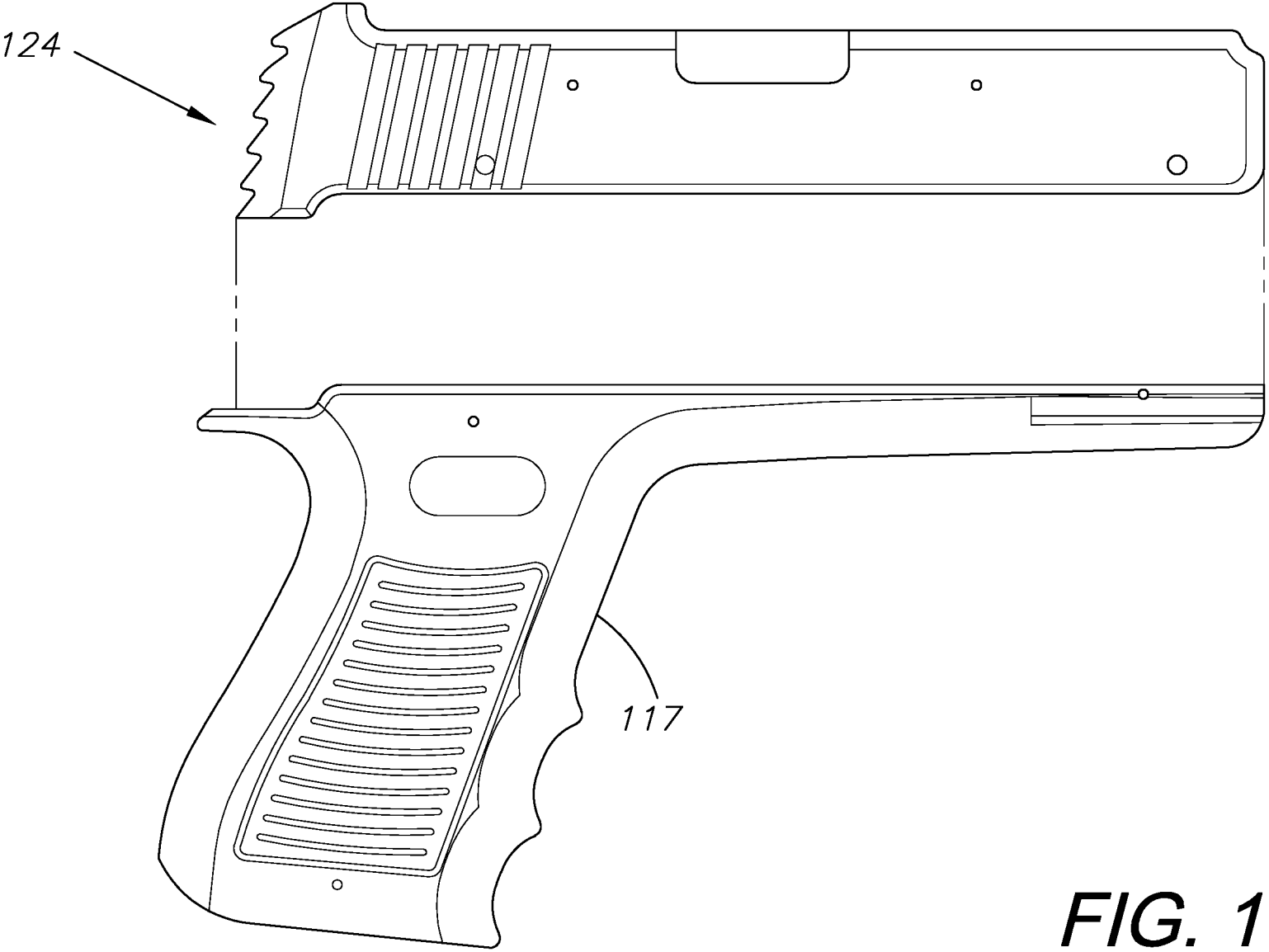
FIG. 17 is a partially-exploded right side elevational view of a right slide element and a right handle element.
Figure 18:
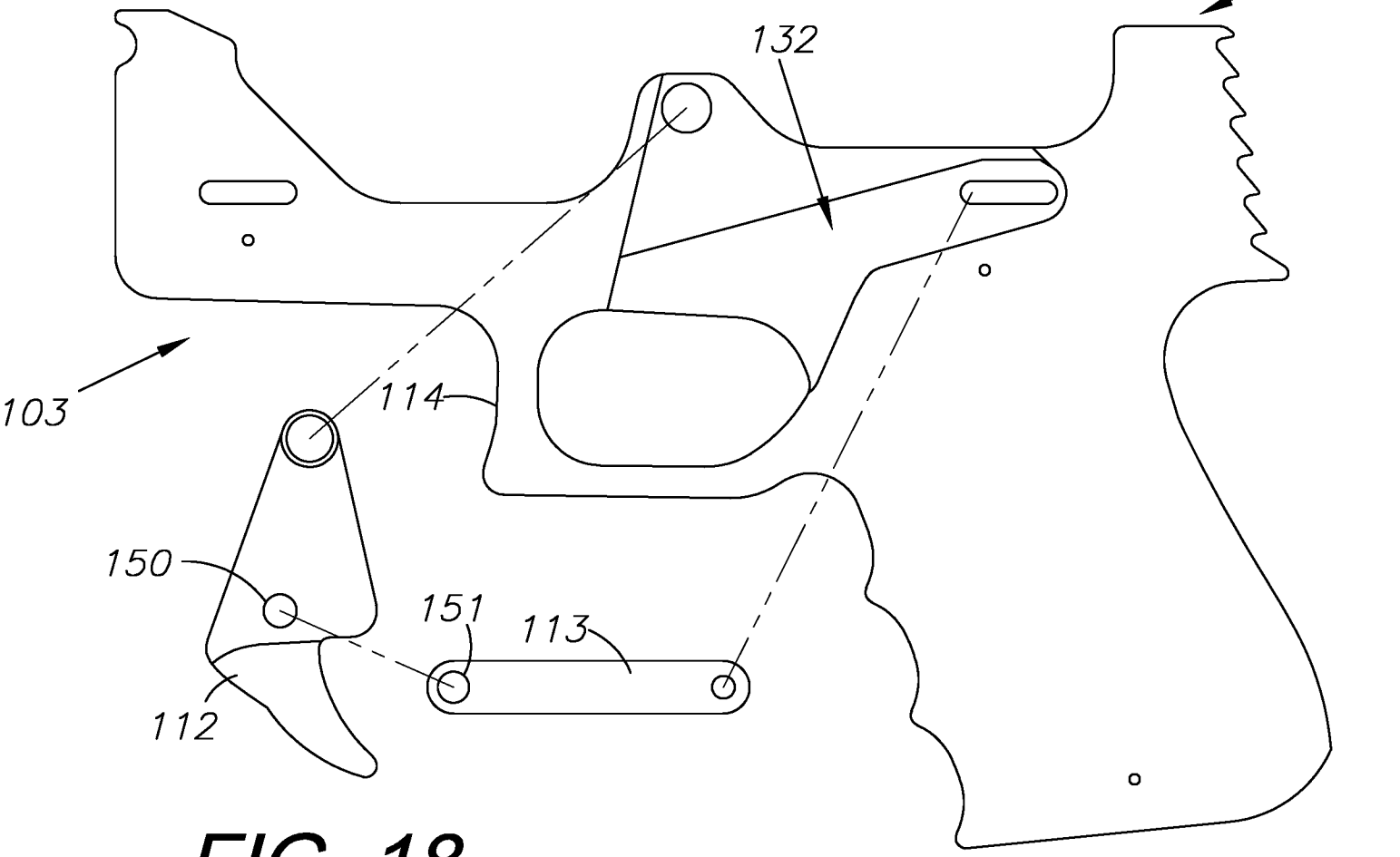
FIG. 18 is a side elevational view of a center handle element and trigger mechanism element.

FIGS. 16 and 17 show how the side handles 116, 117 and slides 104, 124 respectively form the right and left halves of the gun 102. FIG. 18 shows how the center handle 103 portion with the center slide 109 portion forms with the trigger 112 and trigger post 113. A trigger connector 150 and trigger post connector 151 joint the two, such as with a pin or other pivotable connection.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A toy gun comprising:

a gun frame comprising a right handle half, a left handle half, a right slide, a left slide, and a center handle having a front notch, a trigger cavity and a slide relief configured to receive a portion of at least the right slide;

each of said right slide and left slide configured to be pinned and thereby fixedly joined together via at least one slide pin, whereby said right and left slides are configured to be slidably engaged with said center handle;

a front pin further joining said right slide and left slide-while simultaneously being slidably engaged with a front slot within said center handle;

a rear pin further joining said right slide and left slide while simultaneously being slidably engaged with a rear slot within said center handle, and said rear pin connected with a trigger post connected to a trigger, said trigger post and said trigger being disposed within said trigger cavity and said trigger pivotally pinned to at least said right handle half via a trigger pin passing through a trigger pin receiver;

said center handle comprising a plurality of static rear notches;

each of said right and left slides comprising a respective plurality of slide notches;

said trigger configured to be depressed rearwardly from a first position to a second position, thereby causing said trigger to pivot about said trigger pin and said right and left slides to be moved rearwardly via said rear pin and said trigger post.

2. The toy gun of claim 1, wherein said toy gun is modeled after a 9 mm handgun.

3. The toy gun of claim 2, wherein said right handle half includes an exterior recess.

4. The toy gun of claim 1, further comprising:

a plurality of handle pin receivers comprised of holes passing through said left handle half, said center handle, and said right handle half;

a plurality of handle pins configured to be inserted through said plurality of handle pin receivers such that said left handle half, said center handle, and said right handle half are joined.

5. The toy gun of claim 1, further comprising:

said front and rear pins being made of metal.

* * * * *